US007383772B2

(12) United States Patent
Boppel et al.

(10) Patent No.: US 7,383,772 B2
(45) Date of Patent: Jun. 10, 2008

(54) GUIDING ELEMENTS FOR A PRINTING UNIT

(75) Inventors: Johannes Boppel, Frankenthal (DE); Peter Wilhelm Kurt Leidig, Frankenthal (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 433 days.

(21) Appl. No.: 10/531,211

(22) PCT Filed: Oct. 20, 2003

(86) PCT No.: PCT/DE03/03473

§ 371 (c)(1),
(2), (4) Date: Apr. 15, 2005

(87) PCT Pub. No.: WO2004/037537

PCT Pub. Date: May 6, 2004

(65) Prior Publication Data

US 2006/0096476 A1 May 11, 2006

(30) Foreign Application Priority Data

| | | |
|---|---|---|
| Feb. 19, 2003 | (DE) | 103 07 089 |
| May 20, 2003 | (DE) | 103 22 651 |
| Jul. 11, 2003 | (DE) | 103 31 469 |
| Oct. 19, 2003 | (DE) | 102 48 820 |

(51) Int. Cl.
*B41F 13/02* (2006.01)
*B41F 13/06* (2006.01)
*B65H 23/32* (2006.01)

(52) U.S. Cl. ..... 101/228; 226/97.3; 226/97.1

(58) Field of Classification Search ..... None
See application file for complete search history.

(56) References Cited

U.S. PATENT DOCUMENTS

| | | | | |
|---|---|---|---|---|
| 3,245,334 | A | 4/1966 | Long | |
| 3,518,940 | A | 7/1970 | Stroud et al. | |
| 3,744,693 | A * | 7/1973 | Greiner | 242/615.12 |
| 4,361,089 | A * | 11/1982 | Wittkopf et al. | 101/182 |
| 4,416,201 | A | 11/1983 | Kessler | |
| 4,957,045 | A | 9/1990 | Messerschmitt | |

(Continued)

FOREIGN PATENT DOCUMENTS

| | | |
|---|---|---|
| DE | 1 761 595 | 9/1971 |

(Continued)

OTHER PUBLICATIONS

Machine translation of JP 07053102 to Takenaka from Japanese Patent officce website, Feb. 28, 1995.*

*Primary Examiner*—Daniel J Colilla
(74) *Attorney, Agent, or Firm*—Jones, Tullar & Cooper, PC

(57) ABSTRACT

A guiding element for a printing unit is provided to facilitate use of the printing unit in an imprinter function. In one operating situation, a strip is printed as it passes through a printing gap of the printing unit. In another operating situation, the strip is guided through the printing gap by the guiding element in a non-contact manner. The guiding element includes, on the outer surface, a plurality of openings adapted for the discharge of a pressurized fluid. These openings are micro-openings of a diameter less than 500 μm.

58 Claims, 5 Drawing Sheets

U.S. PATENT DOCUMENTS

| | | | | |
|---|---|---|---|---|
| 5,031,528 | A | 7/1991 | Messerschmitt | |
| 5,078,061 | A | 1/1992 | Messerschmitt | |
| 5,316,199 | A | 5/1994 | Hansen et al. | |
| 5,423,468 | A | 6/1995 | Liedtke | |
| 5,464,143 | A | 11/1995 | Hansen | |
| 5,467,179 | A | 11/1995 | Boeck et al. | |
| 5,850,788 | A | 12/1998 | Janser et al. | |
| 5,979,731 | A * | 11/1999 | Long et al. | 226/7 |
| 6,004,432 | A | 12/1999 | Page et al. | |
| 6,364,247 | B1 * | 4/2002 | Polkinghorne | 242/615.11 |
| 6,402,047 | B1 * | 6/2002 | Thomas | 239/14.2 |
| 6,408,747 | B2 | 6/2002 | Koppelkamm et al. | |
| 6,514,623 | B2 | 2/2003 | Endisch et al. | |
| 6,635,111 | B1 | 10/2003 | Holtmann et al. | |
| 6,705,220 | B2 * | 3/2004 | Boucher | 101/228 |
| 6,722,608 | B1 | 4/2004 | Gavit et al. | |
| 6,748,861 | B1 | 6/2004 | Riepenhoff et al. | |
| 6,789,476 | B2 | 9/2004 | Langsch | |
| 6,796,524 | B2 | 9/2004 | Pollock et al. | |
| 7,025,303 | B2 | 4/2006 | Meyer | |
| 7,100,864 | B2 | 9/2006 | Weis | |
| 2004/0134321 | A1 | 7/2004 | Weis | |
| 2005/0017123 | A1 | 1/2005 | Meyer | |
| 2006/0278360 | A1 | 12/2006 | Solberg | |

FOREIGN PATENT DOCUMENTS

| | | | |
|---|---|---|---|
| DE | 2 215 523 | | 10/1973 |
| DE | 31 31 621 | A1 | 6/1982 |
| DE | 31 27 872 | A1 | 2/1983 |
| DE | 32 25 360 | A1 | 2/1984 |
| DE | 32 12 826 | A1 | 1/1989 |
| DE | 42 00 769 | C1 | 7/1993 |
| DE | G 93 11 113.4 | | 10/1993 |
| DE | 93 20 281.4 | | 4/1994 |
| DE | 43 30 681 | A1 | 3/1995 |
| DE | 43 35 473 | | 4/1995 |
| DE | 44 46 546 | A1 | 6/1996 |
| DE | 195 27 761 | A1 | 1/1997 |
| DE | 198 53 414 | A1 | 9/1999 |
| DE | 198 29 094 | A1 | 1/2000 |
| DE | 198 29 095 | A1 | 1/2000 |
| DE | 198 50 968 | A1 | 5/2000 |
| DE | 199 11 965 | A1 | 9/2000 |
| DE | 200 08 665 | U1 | 9/2000 |
| DE | 101 12 416 | | 3/2001 |
| DE | 199 02 936 | | 6/2002 |
| DE | 101 15 916 | A1 | 10/2002 |
| DE | 101 15 918 | A1 | 10/2002 |
| DE | 20303720 | U1 * | 5/2003 |
| DE | 203 09 429 | U1 | 10/2003 |
| EP | 0 705 785 | A2 | 4/1996 |
| EP | 0 933 200 | A1 | 1/1999 |
| EP | 1 369 368 | A1 | 6/2003 |
| GB | 1 420 147 | | 1/1976 |
| GB | 2 122 945 | A | 1/1984 |
| JP | 57-167330 | | 10/1982 |
| JP | 59-192571 | | 10/1984 |
| JP | 61-12396 | | 1/1986 |
| JP | 6-39991 | | 2/1994 |
| JP | 6-198836 | | 7/1994 |
| JP | 7-53102 | | 2/1995 |
| WO | WO00/39011 | | 7/2000 |

* cited by examiner

GUIDING ELEMENTS FOR A PRINTING UNIT

CROSS-REFERENCE TO RELATED APPLICATIONS

This U.S. application is the U.S. national phase, under 35 USC 371, of PCT/DE2003/003473, filed Oct. 20, 2003; published as WO 2004/037537 A2 on May 6, 2004 and claiming priority to DE 102 48 820.7, filed Oct. 19, 2002; to DE 103 07 089.3, filed Feb. 19, 2003; to DE 103 22 651.6, filed May 20, 2003 and to DE 103 31 469.5, filed Jul. 11, 2003, the disclosures of which are expressly incorporated herein by reference.

FIELD OF THE INVENTION

The present invention is directed to printing units with guide elements. The printing unit is adapted for imprinter functions. In one situation, a web is printed in a printing gap. In another situation, the web is conducted, without printing, through the gap.

BACKGROUND OF THE INVENTION

A printing unit with two web guide elements, which two web guide elements are arranged respectively in an inlet and in an outlet area of a printing unit in such a way that, with the printing location disengaged, a web can be conducted through the printing location without touching it, is known from DE 93 11 113 U1. The two web guide elements are embodied as rollers, which are rotatably seated in lateral walls of the printing unit.

A turning bar is disclosed, in one preferred embodiment, in U.S. Pat. No. 3,744,693. A tube wall element made of a porous material which is permeable to air forms a closed pressure chamber in conjunction with a base body. The porous segment constitutes a wall of the chamber and is embodied to be load-bearing over the width of the latter, without a load-bearing support. In a second example, a segment with through-bores is utilized instead of the porous segment.

U.S. Pat. No. 5,423,468 shows a guide element which has an inner body with bores and an outer body of a porous material which is permeable to air. The bores in the inner body are only provided in the expected area of a loop of material which will pass around the guide element.

EP 0 705 785 A2 is concerned with the transport and deflection of web-shaped material, for example in the form of film material. In one embodiment, compressed air flows through the pores of a porous wall with mean pore diameters of 7 to 10 μm, and in another embodiment air flows through a wall having micro-bores with openings of 350 μm.

SUMMARY OF THE INVENTION

The object of the present invention is directed to producing printing units with guide elements for a flying printing former change.

In accordance with the present invention, this object is attained by the provision of a guide element of a printing unit, which printing unit is usable in an imprinter function. In one operational situation, a web is imprinted in a printing gap. In a second operational situation, the web is conducted through the gap without contact by a guide element. The guide element includes a micro-porous air permeable material through which air can pass. The openings may have a diameter of less than 500 μm.

The advantages to be gained by the use of the present invention consist, in particular, in that a dependably and accurately operating web guide element of a printing unit is provided. By the provision of an air cushion which is formed by the micro-openings, a high degree of homogeneity is accomplished over the length of the air cushion, simultaneously with small losses. In contrast to prior rollers, no inertia must be overcome, in particular in the course of changing speeds.

By the provision of air outlet openings, with diameters in the millimeter range, forces can be applied point-by-point to the material, with an impulse of a jet, by the use of which, the material can be kept away from the respective component, or can be placed against another component. By the distribution of micro-openings in the guide element, with a high hole density and with a broad support, as a mailer of priority, the effect of a formed air cushion is applied. The cross-section of bores used in prior devices were, for example, in the range of between 1 and 3 mm. The cross section of the micro-openings, in accordance with the present invention, is smaller by at least the power of ten. Substantially different effects arise from this difference in size. For example, the distance between the surface of the guide element with the openings and the web can be reduced, and because of this, flow losses, which occur outside of the effective areas of the web, can be clearly reduced.

In contrast to prior components with openings, or with bores, having opening cross sections in the millimeter range and a hole distance of several millimeters, a substantially more homogeneous surface is provided with the formation of micro-openings on the surface. Here, micro-openings are understood to mean openings in the surface of the component which have a diameter of smaller than or equal to 500 μm, preferably smaller than or equal to 300 μm, and, in particular, smaller than or equal to 150 μm. A "hole density" of the surface provided with micro-openings is at least one micro-opening per 5 $mm^2$, which is the equivalent of a density of 0.2hole/$mm^2$, and advantageously at least one micro-opening per 3.6 $mm^2$ which results in a density of 0.28 hole/$mm^2$.

Because of the embodiment of the openings of the guide element as micro-openings, the air cushion is made more uniform. The flow volume exiting per surface unit is reduced in such a way that a flow loss can be acceptably small also in the areas of the guide element around which the web is not looped.

The micro-openings can be advantageously provided as open pores at the surface of a porous, and in particular, at the surface of a micro-porous, air-permeable material, or as openings of penetrating bores of small diameter, which extend through the wall of a supply chamber toward the exterior of the guide element. In another embodiment of the present invention, the micro-bores are configured as openings of penetrating micro-bores.

In order to achieve a uniform distribution of air exiting from the surface of the guide element, in the case of employing micro-porous material, and without requiring, at the same time, large layer thicknesses of the material with high flow resistance, it is useful for the guide element to have a rigid air-permeable support, to which support the micro-porous material has been applied as a layer. Such a support can be charged with compressed air, which flows out of the support through the micro-porous layer and, in this way, forms an air cushion on the surface of the component.

On the other hand, the support can be porous and can have a better air permeability than the micro-porous material. It can also be formed of a flat material or of a formed material, which encloses a hollow space and which is provided with air outlet openings. Combinations of these alternatives can also be considered.

To achieve a uniform air distribution, it is moreover desirable that the thickness of the layer corresponds to at least a distance between adjoining openings.

In the case of using micro-bores, an embodiment is advantageous, wherein the side of the guide element which faces the web and which has the micro-openings is embodied as an insert or as several inserts in a support. In a further development of the present invention, the insert can be releasably or, if desired, can be exchangeably connected with the support. In this way, cleaning and/or an exchange of inserts with different micro-perforations, for adaptation to different materials and web widths, is possible.

BRIEF DESCRIPTION OF THE DRAWINGS

Preferred embodiments of the present invention are represented in the drawings and will be described in greater detail in what follows.

Shown are in.

DESCRIPTION OF THE PREFERRED EMBODIMENTS

Figure 1:
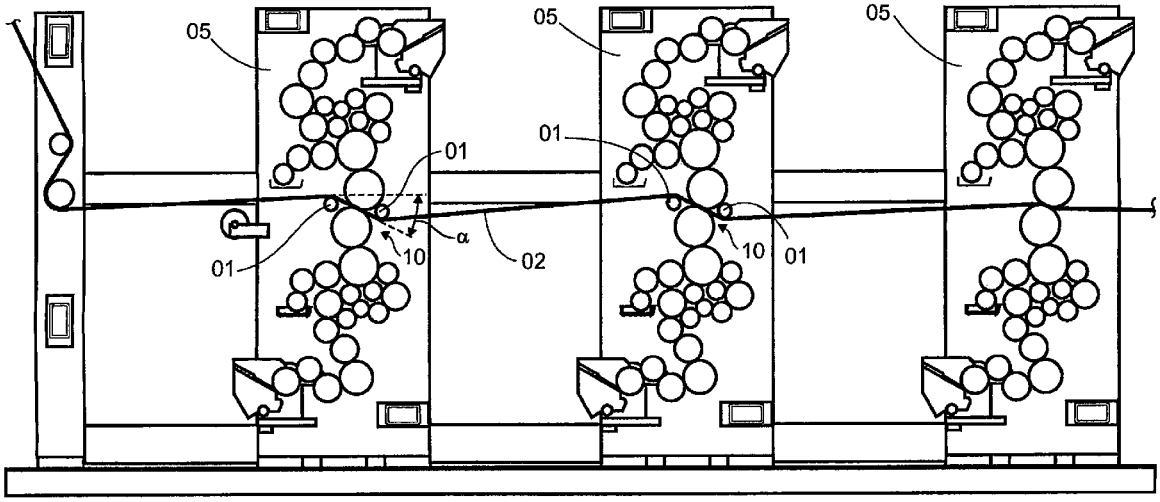
FIG. 1, a schematic side elevation representation of several printing groups through which a web travels, in FIG. 2, a cross-sectional view of a first embodiment of a guide element in accordance with the present invention, in FIG. 3, a cross-sectional view of a second embodiment of a guide element, in FIG. 4, a perspective view of a third embodiment of a guide element, in FIG. 5, a cross-sectional view of a fourth embodiment of a guide element, in FIG. 6, a cross-sectional view of a fifth embodiment of a guide element, in FIG. 7, a perspective view of a sixth embodiment of a guide element, in FIG. 8, a cross-sectional view of a seventh embodiment of a guide element, and in FIG. 9, an end view of an eighth embodiment of a guide element in accordance with the present invention.

A schematic, side elevation view of three printing units 05, for example of three printing groups 05 for sheet work, and in particular of three offset printing groups 05 for sheet work, through which a web 02, such as, for example, a web 02 of material 02, or a web 02 of imprinted material, runs sequentially, is shown in FIG. 1. These printing groups 05 of a printing press can also be constituted in different ways, for example as three-cylinder offset printing groups 05, as a direct or flexographic printing group, as a printing group for letterpress or rotogravure printing, or as individual printing units 05 that are different from each other. For example, at least one of the printing groups 05, which is configured for sheet work, has a guide element 01, and in particular has a web guide element 01, at least in an outlet area of its printing gap 10, for use in changing the direction of travel of a freshly imprinted, not yet dry web 02 at the outlet of the printing group 05. The web guide element 01 can be used, for example, for conducting the web 02 to the printing gap 10 of the next following printing group 05 in the correct orientation. In FIG. 1, the individual printing units 05 are each shown with a web guide element 01 at both an inlet and an outlet area.

A second printing group 05, following the first printing group 05, also has a web guide element 01 in both the inlet and the outlet area of its printing gap 10. This allows the second printing group 05 to be able to conduct a previously imprinted web 02 through its printing gap 10 in a contactless manner while the printing location of this second printing group 05 is disengaged. This second printing group 05 can thus be operated as an imprinting-type printing group 05 or as a printing group 05 for accomplishing a flying printing former change, alternatingly with another such printing group 05. In one operational situation, the web 02 is imprinted by one of the printing groups 05, while passing, without contact, through the second of these printing groups 05. In another operational situation, this sequence is reversed. The two web guide elements 01 may be spatially arranged, for example, in such a way that the web 02 extends substantially perpendicularly with respect to a connecting plane of the two cylinders constituting the printing location. During imprinting operations, one of at least two printing units 05 of the printing press shown in FIG. 1 is in contact with, and imprints the web 02, while the other printing unit 05 is disengaged from web 02 and the web 02 runs through this other printing unit 05 without contact. The printing press preferably has five printing units 05. In one mode of operation of the printing press, one of the five printing units is passed through by the web 02 without contact, while the web 02 is imprinted by the remaining four printing units 05 in four colors, for example on both sides. In a, second operational situation, the printing unit 05, which previously had been passed through, without web contact, is placed into operation in the printing process, while one of the four printing units 05 which had previously been printing the web 02 is now passed by web 02 without contact. At least the two printing units 05, alternatingly through which passage of the web 02, without contact, is to occur, have guide elements 01, as will be described in detail below, in each of the inlet and outlet areas of the respective printing gap 10 of each such printing unit 05.

At least one of the two web guide elements 01 of the printing group 05 configured for alternating printing and specifically at least the web guide element 01 which is arranged in the outlet area of the printing gap 10 of at least one printing unit 05 are or is embodied as a contactless operating web guide element 01, and in particular, as a rod 01, around which air flows, in a manner as will be described in what follows, and as may be seen in FIG. 2.

The surface of the guide element 01 has openings 03, in the form of, for example, micro-openings 03, through which a fluid, such as a gas or a mixture, and in particular, air, which is under higher pressure than the surroundings, flows from an inside located hollow space 04, for example a chamber 04, in particular a pressure chamber 04, during operation of the guide element 01. An appropriate feed line for delivering compressed air into the hollow space 04 is not represented in the drawings.

The guide element 01 has the micro-openings 03 at least on the side of its surface cooperating with the web 02, or on the side of its surface facing the web 02. Guide element 01 can also have the micro-openings 03 on other sides, not facing the web 02. Alternatively, it can be made completely of a material which has the micro-openings 03 at least on its longitudinal section which works together with the web 02.

This simplest embodiment, without a preferred direction for the arrangement of the micro-openings 03, becomes possible because of the provision of the openings 03 as micro-openings 03. Because of this structure, a thinner, but more homogeneous air cushion is produced. At the same time, a required, or a resulting volume flow, and with that also a flow loss over the "open" side, is considerably reduced. In contrast to openings with a large cross section, the high resistance to fluid flow of the micro-openings 03 has a result that the "non-coverage" of an area of openings 03 does not lead to a sort of short-circuit flow through those non-covered openings. The partial resistance falling off via the openings 03 is given a greater weight in the total resistance.

In a first preferred embodiment of several structures of guide elements 01, as seen in FIGS. 2 to 6, the micro-openings 03 are embodied as open pores on the surface of a porous, and in particular, on the surface of a micro-porous, air-permeable material 06, such as, for example, an open-pored sinter material 06, and, in particular, a sinter metal. The pores of the air-permeable porous material 06 have a mean diameter or a mean size of less than 150 μm, for example a size of 5 to 60 μm, and in particular a size of 10 to 30 μm. The material is provided with an irregular amorphous structure.

The selection of the material, its dimensioning and its charging with fluid under pressure have been made in such a way that 1 to 20 standard cubic meters of fluid per $m^2$ of surface, and, in particular, 2 to 15 standard cubic meters of fluid per $m^2$ of surface, exit from the air outlet surface of the sinter material. An air escape of 3 to 7 standard cubic meters per $m^2$ of surface is particularly advantageous.

In an advantageous manner, the sinter surface of the guide element 01 is charged with an excess pressure of at least 1 bar, and in particular of more than 4 bar, out of the hollow chamber 04. Charging the sinter surface of the guide element 01 with an excess pressure of 5 to 7 bar is particularly advantageous.

Figure 2:
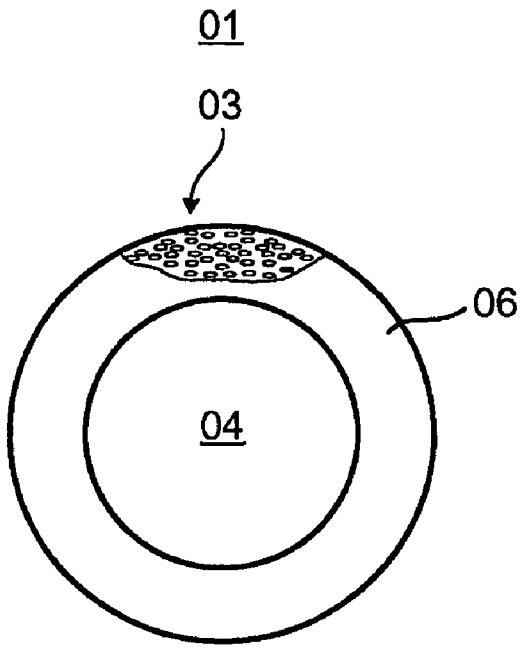
Figure 3:
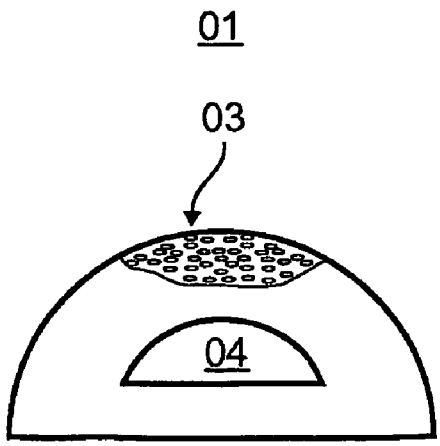

If the hollow space 04 of the guide element 01 is essentially defined only by a body of porous material 06 enclosing the hollow space 04, i.e. without any further load-bearing layers, at least at its longitudinal section, which is acting together with the web 02, this body may be, for example, embodied in the form of a tube, and is embodied to be substantially self-supporting with a wall thickness of more than or at least equal to 2 mm, and in particular with a wall thickness of more than or at least equal to 3 mm, as seen in FIG. 2. If necessary, a support can extend through the hollow space 04, on which support the porous material body can be supported at points, or in certain areas, but which support is not in active contact with the body. Such a body of porous material 06 can also be embodied in the form of a half shell, as represented in FIG. 3.

Figure 4:
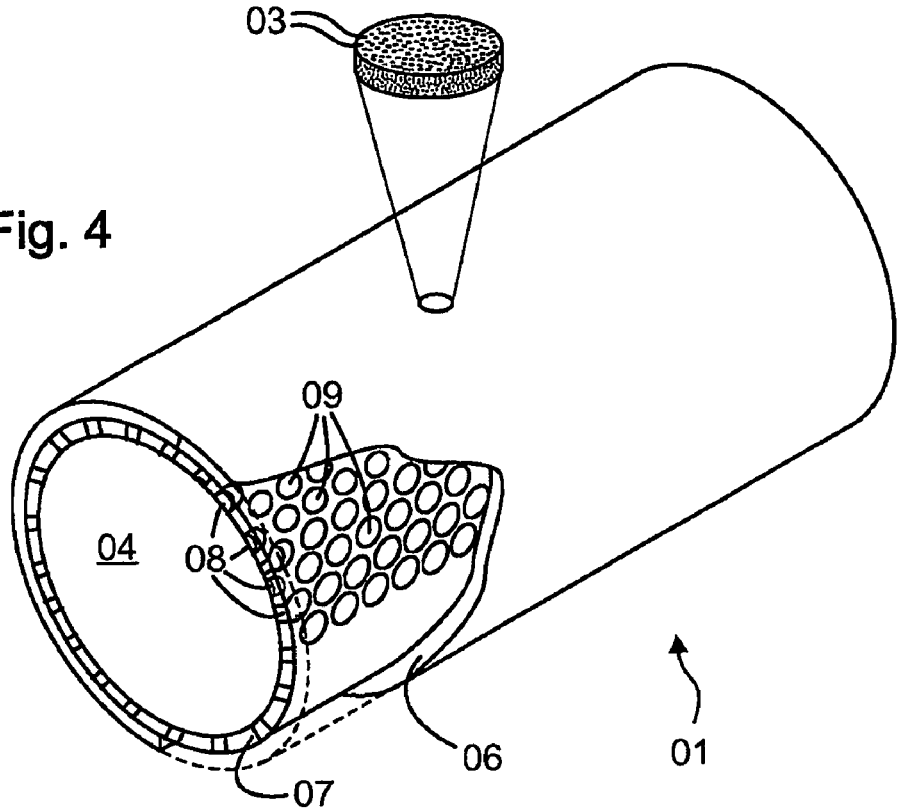
Figure 5:
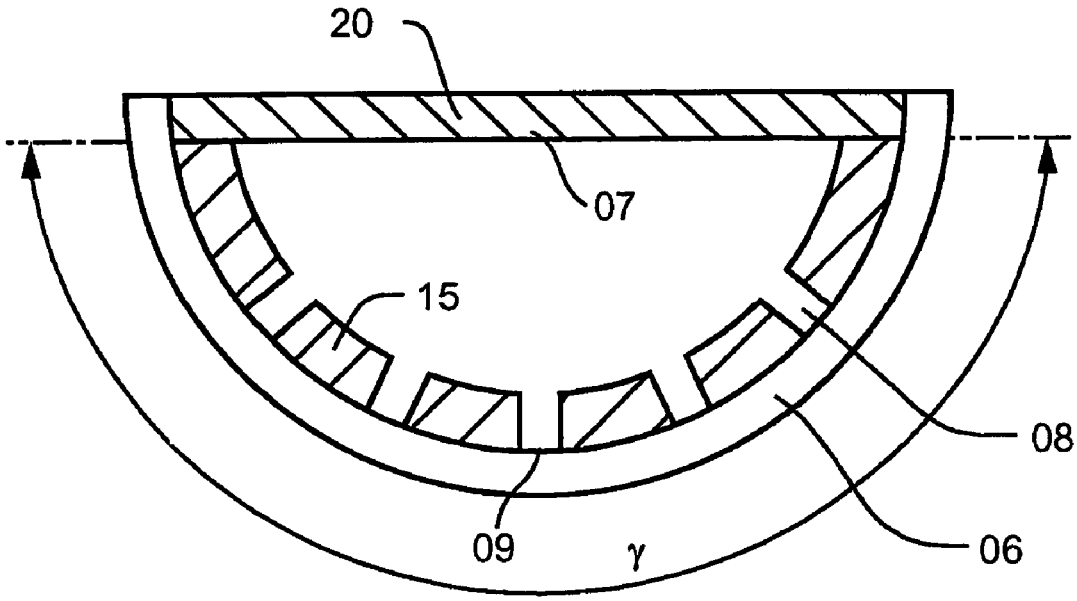
Figure 6:
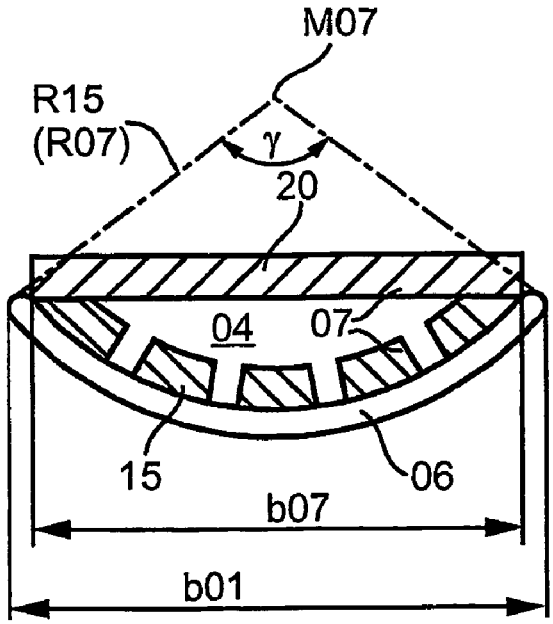

To achieve a uniform distribution of the air exiting at the surface of the micro-porous material 06, without at the same requiring large layer thicknesses of the material 06, with a resultant correspondingly high flow resistance, it is useful, in an advantageous embodiment of the present invention, that the guide elements 01 have a solid support 07, which is air-permeable at least in part and on which solid support 07 the micro-porous material 06 has been applied as an outer layer 06, as shown in FIGS. 4, 5 and 6. Such a support 07 can be charged with compressed air, which compressed air flows out of the support 07 through the micro-porous layer 06 and in this way forms an air cushion at the surface of the guide element 01. In a particularly advantageous embodiment of the present invention, the porous material 06 is therefore not embodied as a supporting solid body, either with or without a frame structure, but instead is provided as a layer 06 on a support material 07, which support material 07 has passages 08 or through-openings 08 and which is, in particular, made of metal. A structure is understood to be the "non-supporting" layer 06 together with the support 07, in contrast to, for example, the above mentioned "self-supporting" layers, wherein the micro-porous layer 06 is supported, over its entire layer length and its entire layer width, on a multitude of support points of the support 07. For example, the support 07 has, over its width and length which is active together with the micro-porous layer 06, a plurality of non-connected passages 08. This embodiment is clearly different from the embodiment in which a porous material 06, which is extending over the entire width and which is active together with the web 02, is configured to be self-supporting over this distance, and is only supported in the end area on a frame or a support, and therefore must have an appropriate thickness.

In the preferred embodiment represented in FIGS. 4, 5 and 6, the underlying support material absorbs substantially all of the weight, torsion, bending and/or shearing forces of the component, for which reason an appropriate wall thickness, for example greater than 3 mm, and in particular greater than 5 mm of the support 07 and/or an appropriately reinforced construction has been selected. The support 07 which, for example, defines the hollow space 04 facing toward the micro-porous layer 06, or which constitutes the hollow space 04 by an appropriate shaping, for example by being tube-shaped, as seen in FIG. 4, has, on the side of support 07 that is coated with the micro-porous material 06, a plurality of openings 09 for the supply of compressed air to the micro-porous material 06. Micro-porous material 06 can also be partially located in the openings 09 of the support 07 in the area of the walls.

As represented in FIGS. 4, 5 and 6, the guide element 01 has the support 07, which is also called the base body 07, with the hollow or inner space 04, and which may be, for example, a tube-shaped support 07, as seen in FIG. 4, which support 07 has a plurality of the penetrating openings 09 in its wall and extending radially as far as the surface. In principle, the support 07 can be configured with any arbitrary hollow profile, but advantageously it is configured with a ring-shaped profile. During the operation, a fluid, for example gas, which is at a pressure P that is greater than the ambient pressure, is blown through the hollow space 04 and out through the openings 09, for example by the use of a compressor, which is not specifically represented. At least in the section provided with the openings 09, the surface of the support 07 has the layer 06 of a micro-porous material, which layer 06 also covers the openings 09 and extends continuously over the area of the guide element 01 which is working together with the web 02, i.e. a continuous surface at least in the area of the guide element 01 which is provided for looping the web 02.

In another embodiment of the present invention, as seen in FIGS. 5 and 6, the hollow space 04 is not constituted by a tube with a support 07 configured in a ring shape, but which instead is structured with a different geometry. Advantageously, the support 07 has a wall 15 in the shape of a segment of a circle, or a wall 15, in particular with a fixed radius, or with a radius of curvature R07 or R15 in relation to a fixed center M07, which is closed on its open side, for example by a cover 20. This wall 15, in the shape of a segment of a circle with the cover 20, can be embodied as one piece or as several pieces, which are however connected with each other. In FIG. 5 the angle γ of the partial circle of the wall 15 having the openings 09 has been selected to be approximately 180°. With a defined width b01 of the guide element 01, as seen in FIG. 6 and with this defined width being limited, for example because of a maximum width which is predetermined for reasons of structural space, the largest possible area of the guide element 01 can be achieved with this step. With a desired or with a predetermined width b01, the radius R15 of the partial circle, or of the tube used as the raw material is selected on the basis of the desired deflection, deflection angle α of the change of direction of the web 02; as seen in FIG. 1, and an appropriate partial circle is used. In this way, a change of direction takes place as "softly" as possible and is supported by the air cushion over the largest possible area in the available structural space.

In the representation of FIG. 6, the angle γ of the partial circle is less than 180°, and, for example, is between 10° and 150°, and in particular is approximately 90° here. In a preferred embodiment, for use in the area of the printing gap, either upstream and/or downstream of the printing unit 05, the angle γ of the partial circle has been selected to be 10° to 45°, and in particular, between 15° and 35°. The width b01 has been selected to be, for example, between 30 to 150 mm, and in particular to be between 50 to 110 mm. The radius of curvature R15 of the wall 15 of the support 07 is, for example, between 120 and 150 mm, and in particular, is between 140 and 200 mm. As was the case in FIG. 5, the micro-porous layer 06 can be extended as far as the front cover 20, or it can only cover the curved wall 15 of support 07 containing the openings 09. In its end areas, the micro-porous layer 06 can also be flattened to form a soft transition.

By the above-mentioned steps, a surface of an air cushion, which is as large as possible and which acts as a support, can be achieved at a width b01 of the guide element 01 or at a width b07 of the support 07, such as for example, a maximum width that may be preset for reasons of structural spacing. At a desired or at a predetermined width b01, the radius R07 of the partial circle, or of the tube used as the raw material is selected on the basis of the required web directional change, represented by way of example as the deflection α of the change of direction of the web 02 in FIG. 1 in the first printing unit 05, and an appropriate partial circle is used. By this selection, a change of direction takes place as "softly" as possible and is aided by the air cushion over the largest possible area in the structural space available.

In an advantageous embodiment of the present invention the configuration of the guide element 01 is such that the partial circle angle γ of the wall 15 is formed from the deflection angle α desired for the course of the web 02, wherein $\gamma=\alpha+\Delta$, and wherein Δ is an addition for an assumed run-up and run-off of the web 02 and is selected to lie between 0° and 50°, and in particular is selected to lie between 10° and 30°. The radius of curvature R07 of the support 07 is then selected to be such that, taking the addition A into consideration, the desired width b01 or b07 is maintained. The radius of curvature R15, or R07 is then selected to be R15 or R07=b01/(a*sin(y/2)). An excess projection possibly created by the layer thickness is negligible because of the slight thickness. Thus, while taking dependability into consideration, a large active surface is formed, together with an optimal use of the space.

With needed deflection angles α starting at, for example, 120°, a semi-circular profile or even a full circle profile can be of advantage for the guide element 01, for reasons of simplification. In this case, the opening 09 and/or the micro-porous layer 06 can include the full 360° angle, or only a partial circle.

Basically, other profiles, differing from partial circles, are conceivable for the area of the guide element 01 or of its curved wall 15 interacting with the web 02, such as, for example, a section of an ellipse, parabola or hyperbola. In this connection, the curved shape of the directional change can be optimized in view of a "soft" directional change. However, the partial circle shape has advantages with respect to standardization, to material use and for simplified manufacture.

In contrast with the embodiment of a guide element 01, wherein the micro-porous material 06 is not underlaid, to a great extent, by a support 07 or by a base body 07 having openings 09, but instead is only supported, for example, in a bridge-like manner, on a frame-like support in edge areas, the embodiment of the shape of a base body 07 in the shape of a partial circle, an ellipse, a parabola or a hyperbola, directly underneath the micro-porous layer 06, has great advantages with respect to manufacture, to dimensional stability, to costs and to handling. For example, with this embodiment, at least half of the surface of the micro-porous layer 06, working together with the web 02, is underlaid by the support 07, or by its curved wall 15, and/or by openings 09 or free cross sections have a diameter or a maximum inside width of 10 mm, and in particular off less than or equal to 5 mm.

In connection with the above-mentioned examples embodied with the support 07, the micro-porous material 06 located outside of the passage 08 has a layer thickness which is less than 1 mm. A layer thickness of this micro-porous material 06, between 0.05 mm and 0.3 mm is particularly advantageous. A proportion of the open face, in the area of the effective surface of the porous material, here called degree of opening, lies between 3% and 30%, and preferably lies between 10% and 25%. To achieve an even distribution of air it is furthermore desirable for the thickness of the micro-porous layer 06 to correspond at least to the distance between adjoining openings 09 in the support 07.

The wall thickness of the support 07 is, at least in the area with the layer, preferably greater than 3 mm, in particular is greater than 5 mm.

The support 07, provided with a hollow profile, if desired, can itself also be made of a porous material, but with a better air permeability, for example with a greater pore size, than that of the micro-porous material of the layer 06. In this case, the openings 09 of the support 07 are constituted by open pores in the area of the surface, and the passages 08 are constituted by channels which are incidentally formed in the interior because of the pores. However, the support 07 can also be constituted by any arbitrary flat material enclosing the hollow space 04 and which is provided with passages 08, or by formed material. Combinations of this alternative can also be considered.

Figure 7:
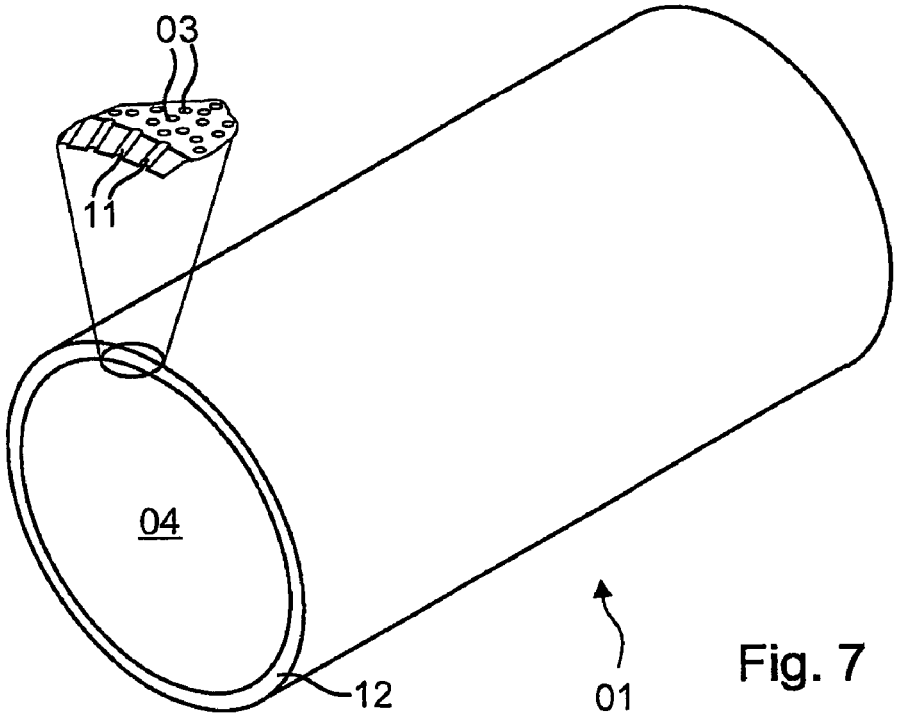
Figure 8:
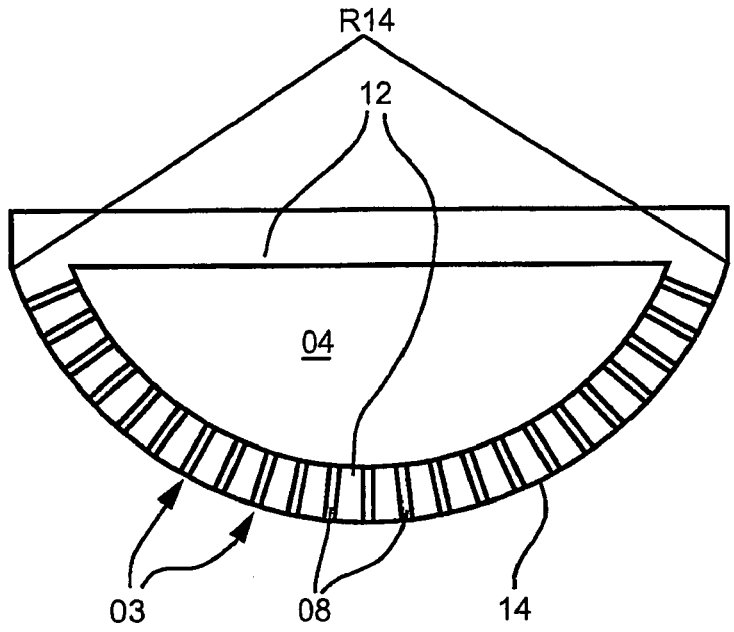
Figure 9:
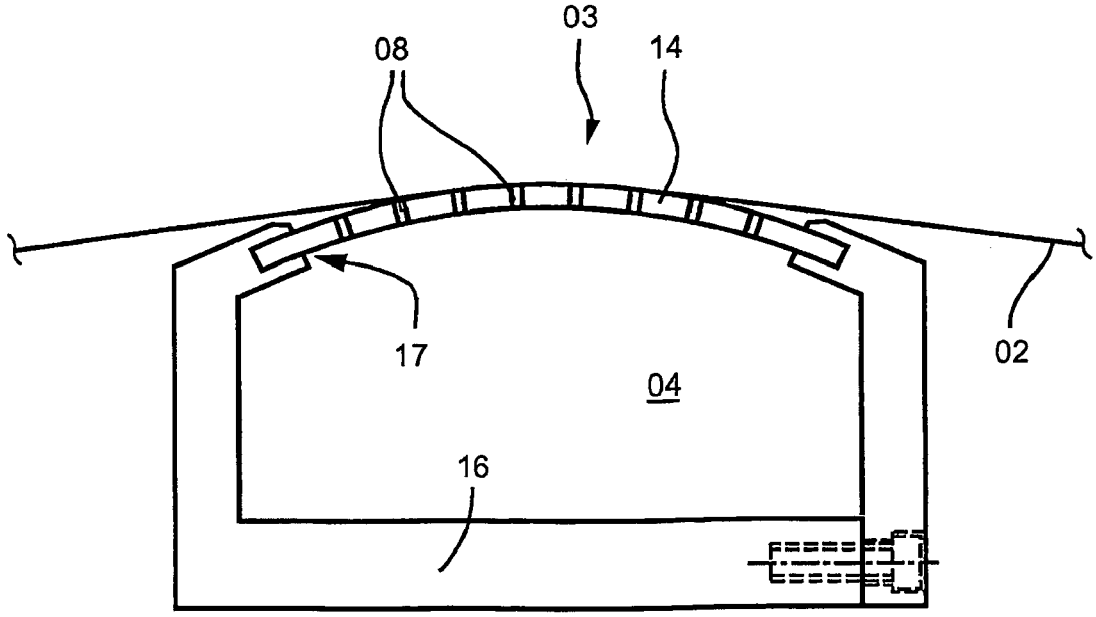

In a second preferred embodiment of the present invention, as seen in FIGS. 7 to 9, the micro-openings 03 are configured as openings of penetrating bores 11, and in particular of micro-bores 11, which extend outward through a wall 12, for example a chamber wall 12, which chamber wall is bordering a hollow chamber 04, for example configured as a pressure chamber 04. For example, the micro-bores 11 have a diameter, at least in the area of the openings 03, of less than or equal to 500 μm, advantageously less than or equal to 300 μm, and in particular between 60 and 150 μm. The degree of opening lies between 3% to 25%, and in particular lies between 5% to 15%, for example. The hole density is at least ⅕ $mm^2$, and in particular is at least $1/mm^2$ up to $4/mm^2$. Therefore, the wall 12 of the web guide element 01 has a micro-perforation, at least in an area located opposite the web 02. The micro-perforation advantageously extends over the area which works together with the web 02. However, it can extend as the passages 08 and the micro-porous layer 06 in the first preferred embodiment, over the full circumference of 360° since, as mentioned, the losses are kept within limits.

In a second preferred embodiment of the guide element 01 with micro-bores 11, as seen in FIG. 8, the chamber wall 12 has, on the side facing the web 02, a curved wall 14 or a curved wall section 14, which is comparable with the curved wall 15 described in connection with FIGS. 5 and 6, which has the micro-bores 11. What has been said in connection with the angles α, γ, Δ and in connection with the width b01 or b07, here b01 or b12 and the radius R15 here R14 in connection with FIGS. 5 and 6, as well as with the way of proceeding and the selection of the radii of curvature, should be applied in the same way to the described example.

In a preferred embodiment of the present invention, in accordance with FIG. 9, the wall 14 with the micro-bores 11 is embodied as an insert 14 or as several inserts 14 which may be arranged side by side in a support 16. Each insert 14 can be connected, either fixedly or releasably, or exchangeably in the support 16. The releasable connection is advantageous in view of possible cleaning or of an exchange of inserts 14 with different micro-perforations for adaptation to different materials, with a different mass and/or surface structure, and web widths. In the variation of this embodiment of the present invention, with inserts 14 and/or with micro-openings substantially arranged over the full circumference, such inserts 14 can, for example, be arranged on a support 16 extending in the hollow space 04. However, an embodiment of the present invention is also advantageous wherein, as represented in FIG. 9, the insert 14 with the openings 09 is only embodied over an angle segment with a curvature, in particular with a curvature that is matched to the path of the web.

Again, what was previously said in connection with the angles α, γ, Δ and the width b01 or b07, here b01 or b12 and the radius R15 here R14 in connection with FIGS. 5 and 6, as well as with the way of proceeding and the selection of the radii of curvature, should be applied in the same way to the present example for embodying the curved surface of the insert 14, or inserts 14. However, here a projection or a difference between an insert width and a support width must possibly be taken into consideration. The curvature can be forced, for example, by an intentional excess width of the insert 14 with respect to the support 16, or the fastening arrangement of the latter in the form of a resultant bending.

As represented in FIG. 9, the releasable connection between the inserts 14 and the support 16 can be realized, for example, by the provision of grooves 17 in the support 16, which grooves 17 receive the ends of the insert 14. In addition, or instead, a connection can also be made by screwing or clamping.

A wall thickness of the chamber wall 12 or the insert wall 14 or of the insert 14 containing the bores 11 which thickness, inter alia, affects the flow resistance, can be between 0.2 to 0.3 mm, is advantageously between 0.2 to 1.5 mm, and in particular is set at 0.3 to 0.8 mm, for all of the examples concerned. With the smaller ones of the wall thicknesses mentioned in particular, a reinforcing structure, such as, for example, a support extending in the longitudinal direction of the guide element 01, and in particular a metal support, can be arranged in the interior of the guide element 01, and in particular can be arranged in the hollow space 04, on which the chamber wall 12. the wall 14, or the insert 14 are supported at least in part or at points. This support can, for example, be provided by ribs which are spaced apart from each other in the axial direction.

In connection with the embodiment of the micro-openings 03 in the form of bores 11, an excess pressure in the chamber 04 of, for example, 0.5 to 2 bar, and in particular of 0.5 to 1.0 bar, is advantageous.

The bores 11 can be configured to be cylindrical, funnel-shaped or in another special shape, such as, for example, in the form of a Laval nozzle.

The micro-perforation, i.e. the making of the bores 11, preferably takes place by drilling by the use of accelerated particles, such as, for example, a liquid, such as a water jet, ions or elementary particles, or by the use of electromagnetic radiation of high energy density, for example by light in the form of a laser beam. The making of the micro-perforations by the use of an electron beam is particularly advantageous.

The side of the wall 12 or 14 having the bores 11 and facing the web 02, for example a wall 12 or 14 made of special steel, in a preferred embodiment has a dirt and inkrepelling finish. It has a coating which is not specifically represented of, for example nickel or advantageously chromium which coating does not cover the openings 03 or bores 11, and which coating has, for example, been additionally treated for example with micro-ribs or is structured in a lotus flower-effect, or which preferably has been polished to a high gloss.

While preferred embodiments of a printing unit with guide elements, in accordance with the present invention, have been set forth fully and completely hereinabove, it will be apparent to one of skill in the art that various changes in, for example the structure of the printing units, the source of supply of the fluid under pressure and the like could be made without departing from the spirit and scope of the present invention which is accordingly to be limited only by the appended claims.

What is claimed is:

1. A printing press comprising:

at least a first printing unit including at least two cylinders defining a printing gap having an inlet area and an outlet area, said at least first printing unit being adapted for imprinter operation wherein in a first operational situation a web is imprinted in said printing gap and in a second operational situation the web is conducted without contact with said at least two cylinders in said printing gap;

a first guide element in said inlet area and a second guide element in said outlet area;

a wall of said at least second guide element, said wall including an outer surface having a surface area defining said guide element; and a plurality of outward-directed penetrating bores configured as micro-bores in said wall, each of said micro-bores having a diameter no greater than 500 μm, a density of said plurality of outwardly directed penetrating micro-bores per unit of said surface area being at least 0.2/mm$^2$, said plurality of outwardly directed penetrating micro-bores being adapted for the exit of a fluid under pressure.

2. The printing press of claim 1 wherein each said guide element has a circular profile.

3. The printing press of claim 1 wherein each said guide element has a half-shell cross-sectional profile.

4. The printing press of claim 1 wherein each said guide element has a web-facing side having a cross-sectional profile in the shape of a segment of a circle.

5. The printing press of claim 4 wherein said segment of a circle extends over an angle of between 10° and 45°.

6. The printing press of claim 4 wherein a width of said at least second guide element is between 30 and 150 mm.

7. The printing press of claim 1 wherein said diameter of said openings is not greater than 300 μm.

8. The printing press of claim 1 wherein said wall has a thickness of between 0.2 mm and 3.0 mm.

9. The printing press of claim 1 wherein said plurality of outward-directed penetrating micro-bores are adapted to discharge between 1 and 20 cubic meters of fluid per hour for each square meter of said surface.

10. The printing press of claim 9 wherein said fluid discharge rate is between 2 and 15 cubic meters of fluid per hour for each square meter of said surface.

11. The printing press of claim 1 further including a feed line adapted to feed fluid to said at least second guide element, said feed line having an interior diameter of less than 100 mm.

12. The printing press of claim 1 wherein each said guide element has an exterior diameter of between 60 and 100 mm.

13. The printing press of claim 1 wherein each said guide element has a length greater than 1,200 mm.

14. The printing press of claim 1 wherein said fluid under pressure is air.

15. The printing press of claim 1 wherein a portion of said at least second guide element is a releasable insert on a support defined by said wall.

16. The printing press of claim 15 wherein said wail has a profile which is matched to a path of travel of the web.

17. The printing press of claim 15 wherein said segment of a circle extends over an angle of between 10° and 45°.

18. The printing press of claim 1 further including a second printing unit, one of said first and second printing units being adapted to print the web in a first mode of operation of the printing press while the web is conducted without contact through the other of said first and second printing units, and further where, in a second mode of operation, said one printing unit is disengaged from the web and the other of said first and second printing units is in contact with the web.

19. The printing press of claim 1 further including five printing units through which the web is conducted.

20. The printing press of claim 1 wherein said micro-bores are made by accelerated particles.

21. The printing press of claim 1 wherein said micro-bores are made by electron beams.

22. The printing press of claim 1 further including a dirt and ink repelling coating on at least said surface area of said at least second guide element.

23. The printing press of claim 22 wherein said coating is chromium.

24. The printing press of claim 23 wherein said surface area is polished to a high gloss.

25. A printing press comprising:

at least a first printing unit including at least two cylinders defining a printing gap having an inlet area and an outlet area, said at least first printing unit being adapted for imprinter operation wherein in a first operational situation a web is imprinted in said printing gap and in a second operation situation the web is conducted without contact with said at least two cylinders in said printing gap;

a first guide element in said inlet area and a second guide element in said outlet area; and a load bearing support of an at least partially fluid-permeable support material having a plurality of through-openings, said support material forming said at least second guide element, said at least partially-fluid permeable support material having an outer, non-supporting layer constituted as a micro-porous, air-permeable material having a plurality of micro-openings, said outer, non-supporting layer being located on said at least partially fluid-permeable support material and in fluid communication with said plurality of through openings in said support material in at least an outlet area of said second guide element which is adapted to be contacted by the web, said second guide element being formed as a hollow rod around which air flows.

26. The printing press of claim 25 wherein each said guide element has a circular profile.

27. The printing press of claim 25 wherein each said guide element has a half-shell cross-sectional profile.

28. The printing press of claim 25 wherein each said guide element has a web-facing side having a cross-sectional profile in the shape of a segment of a circle.

29. The printing press of claim 28 wherein said segment of a circle extends over an angle of between 10° and 45°.

30. The printing press of claim 28 wherein a width of said at least second guide element is between 30 and 150 mm.

31. The printing press of claim 25 wherein said non-supporting outer layer having said plurality of micro-openings is adapted for the exit of fluid under pressure, each said micro-opening having a diameter of no greater than 500 μm.

32. The printing press of claim 31 wherein said micro-openings are open pores of a porous material.

33. The printing press of claim 32 wherein said pores have a mean diameter of 5 to 50 μm.

34. The printing press of claim 33 wherein said mean diameter is between 10 and 30 μm.

35. The printing press of claim 32 wherein said pores have a mean diameter of 5 to 50 μm.

36. The printing press of claim 35 wherein said mean diameter is between 10 and 30 μm.

37. The printing press of claim 32 wherein said non-supporting micro-porous material is an open-pored sinter material.

38. The printing press of claim 31 wherein said micro-openings of said non-supporting outer layer are adapted to discharge between 1 and 20 cubic meters of fluid per hour for each square meter of said surface.

39. The printing press of claim 38 wherein said fluid discharge rate is between 2 and 15 cubic meters of fluid per hour for each square meter of said surface.

40. The printing press of claim 31 further including a feed line adapted to feed fluid to said at least second guide element, said feed line having an interior diameter of less than 100 mm.

41. The printing press of claim 31 wherein each said guide element has an exterior diameter of between 60 and 100 mm.

42. The printing press of claim 31 wherein each said guide element has a length greater than 1,200 mm.

43. The printing press of claim 31 wherein said fluid under pressure is air.

44. The printing press of claim 25 wherein said non-supporting micro-porous material is an open-pored sinter material.

45. The printing press of claim 25 wherein said at least partially fluid-permeable support material has a support face supporting said outer non-supporting layer.

46. The printing press of claim 25 wherein said outer non-supporting layer has a thickness of less than 1 mm.

47. The printing press of claim 25 wherein said at least partially fluid-permeable support material has a plurality of unconnected fluid passages forming said through-openings and underlying said outer non-supporting layer.

48. The printing press of claim 25 wherein said load bearing support is a support tube with a hollow profile.

49. The printing press of claim 25 wherein a wall of said support material carries said outer, non-supporting layer, said wall a profile with a curvature adapted to a path of travel of the web.

50. The printing press of claim 49 wherein said wall of said support material has a curved profile in the shape of a segment of a circle.

51. The printing press of claim 50 wherein said segment of a circle extends over an angle of between 10° and 45°.

52. The printing press of claim 50 wherein a width of said at least second guide element is between 30 and 150 mm.

53. The printing unit of claim 25 wherein said support material includes a wall having a thickness greater than 3 mm.

54. The printing press of claim 25 wherein said micro-openings constitute between 3% and 30% of said outlet area.

55. The printing press of claim 25 wherein said outer, non-supporting layer of said micro-porous material is charged with fluid at least 1 bar of excess pressure.

56. The printing press of claim 55 wherein said fluid has a pressure of at least 4 bar.

57. The printing press of claim 25 further including a second printing unit, one of said first and second printing units being adapted to print the web in a first mode of operation of the printing press while the web is conducted without contact through the other of said first and second printing units, and further where, in a second mode of operation, said one printing unit is disengaged from the web and the other of said first and second printing units is in contact with the web.

58. The printing press of claim 25 further including five printing units through which the web is conducted.

* * * * *

UNITED STATES PATENT AND TRADEMARK OFFICE

CERTIFICATE OF CORRECTION

PATENT NO. : 7,383,772 B2
APPLICATION NO. : 10/531211
DATED : June 10, 2008
INVENTOR(S) : Johannes Boppel and Peter Wilhelm Kurt Leidig It is certified that error appears in the above-identified patent and that said Letters Patent is hereby corrected as shown below:

Col. 11 line 25 after “said” change “wail” to --wall--.

Col. 13 line 3 after “wall” insert --having--.

Signed and Sealed this

Twenty-sixth Day of August, 2008

JON W. DUDAS
*Director of the United States Patent and Trademark Office*